US007108265B1

(12) United States Patent
Dargue

(10) Patent No.: US 7,108,265 B1
(45) Date of Patent: Sep. 19, 2006

(54) WAGERING CARD GAME WITH MULTIPLE STAGES

(75) Inventor: Stan Dargue, Toronto (CA)

(73) Assignee: Diavolo Gaming, Scottsdale, AZ (US)

( * ) Notice: Subject to any disclaimer, the term of this patent is extended or adjusted under 35 U.S.C. 154(b) by 0 days.

(21) Appl. No.: 11/224,686

(22) Filed: Sep. 12, 2005

(51) Int. Cl.
*A63F 1/00* (2006.01)

(52) U.S. Cl. ..... 273/292; 273/138; 273/139

(58) Field of Classification Search ..... 273/292, 273/138, 139
See application file for complete search history.

(56) References Cited

U.S. PATENT DOCUMENTS 5,494,295 A * 2/1996 Potter et al. ..... 273/292
5,496,038 A * 3/1996 Kangsanaraks ..... 273/292
5,660,392 A * 8/1997 Hansen ..... 273/292
6,102,402 A * 8/2000 Scott et al. ..... 273/292
6,676,128 B1 * 1/2004 Wolf ..... 273/292
6,733,012 B1 * 5/2004 Bui et al. ..... 273/292
6,776,416 B1 * 8/2004 Jackson ..... 273/292
6,789,801 B1 * 9/2004 Snow ..... 273/292
6,808,173 B1 * 10/2004 Snow ..... 273/292
6,902,166 B1 * 6/2005 Stern ..... 273/292
6,938,900 B1 * 9/2005 Snow ..... 273/292
2003/0042679 A1 * 3/2003 Snow ..... 273/292

* cited by examiner

*Primary Examiner*—Eugene Kim
*Assistant Examiner*—Dolores Collins
(74) *Attorney, Agent, or Firm*—Muskin & Cusick LLC

(57) ABSTRACT

A card game that can be used for wagering purposes. A series of successive stages is played by a player against a dealer. At each stage, the player tries to obtain a predetermined point total without going over, and the dealer does the same. The party (dealer or player) with the closest point total to the predetermined point total without going over will win that respective stage.

15 Claims, 8 Drawing Sheets

WAGERING CARD GAME WITH MULTIPLE STAGES

BACKGROUND OF THE INVENTION

1. Field of the Invention

The present invention is directed to a method, apparatus, and computer readable storage medium directed to a casino wagering game in which wagers can place multiple wagers for respective stages.

2. Description of the Related Art

Casino games are currently a billion dollar industry. Casinos are always looking for new games to attract players to their casinos. Brag has always been a popular wagering game, in which players can make three card poker hands. Blackjack has also always been a popular wagering game, in which players try to achieve a particular point total without exceeding the point total.

A game that can have elements of both brag and blackjack would be exciting for players. Therefore, what is needed is a new type of wagering game that can combine elements of both of these games as well as that can generate a lot of casino action which results in more profit for the casino.

SUMMARY OF THE INVENTION

It is an aspect of the present invention to provide an enjoyable card game that can be used for wagering.

The above aspects can be obtained by a method that includes (a) receiving a first wager from a player; (b) allowing the player to receive and view card(s) until the player decides to stop or a point total of all player cards dealt is greater than a first stage threshold; (c) if the point total of all player cards exceeds the first stage threshold, then taking the first wager from the player; (d) allowing the dealer to continue to receive and view card(s) while a point total of all dealer cards is less than a dealer first stand hand; and (e) if the point total of all player cards does not exceed the first stage threshold and the point total of all player cards is closer to the first threshold than the point total of all dealer cards, then paying the player based on the first wager.

The above aspects can also be obtained by a method that includes (a) receiving a first wager and a second wager from the player; (b) revealing an initial first stage card to the player; (c) allowing the player to receive additional first stage card(s) as many times as the player wishes or until a first stage point total of the initial first stage card and the additional first stage card(s) exceed a first threshold; and (d) if the first stage point total exceeds the first threshold then the player has lost the first wager, otherwise paying the player a multiple of the first wager based on the first stage point total.

The above aspects can also be obtained by an apparatus that includes (a) a receiving unit to receive a first wager from a player; (b) a player allowing unit to allow the player to receive and view card(s) until the player decides to stop or a point total of all player cards dealt is greater than a first stage threshold; (c) a taking unit, if the point total of all player cards exceeds the first stage threshold, to take the first wager from the player; (d) a dealer allowing unit to allow the dealer to continue to receive and view card(s) while a point total of all dealer cards is less than a dealer first stand hand; and (e) a paying unit, if the point total of all player cards does not exceed the first stage threshold and the point total of all player cards is closer to the first threshold than the point total of all dealer cards, to pay the player based on the first wager.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
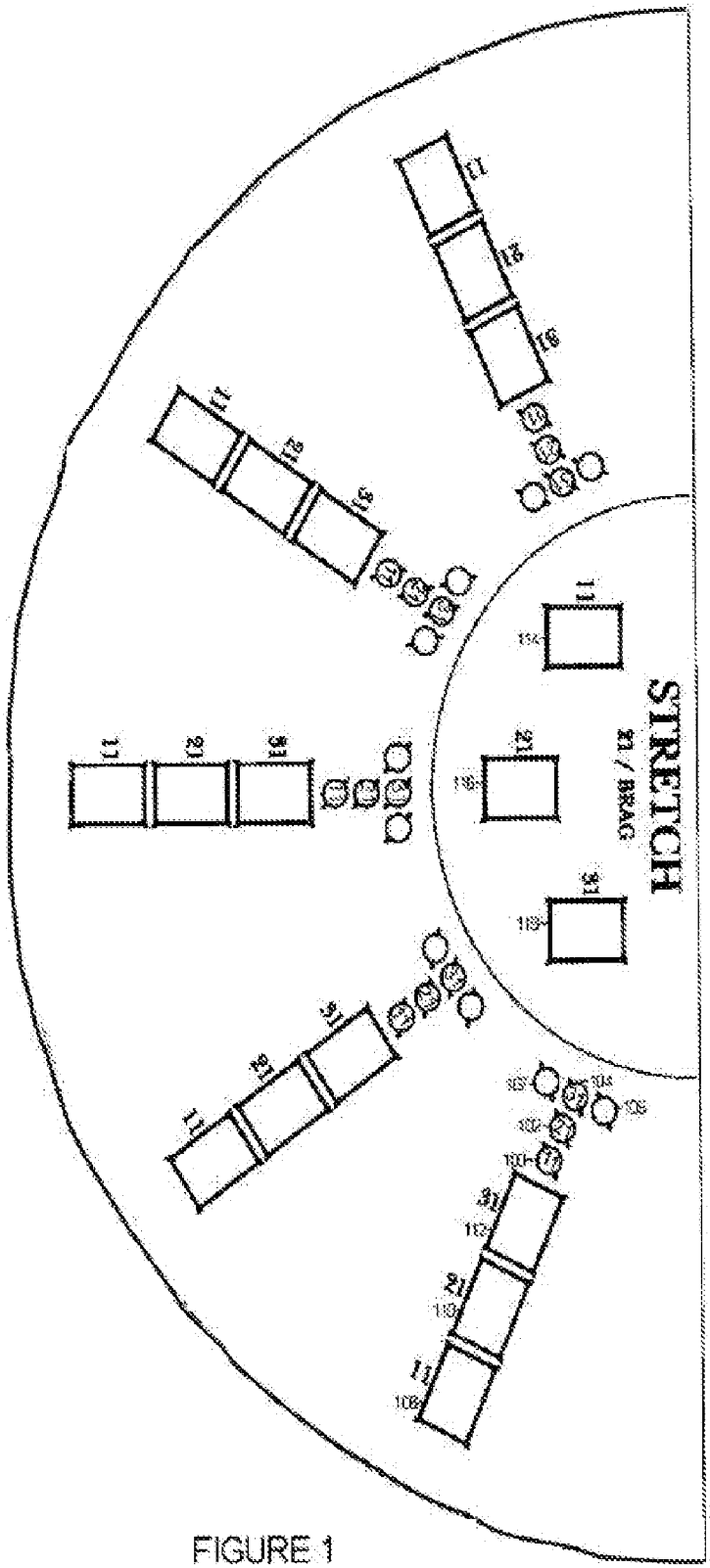
FIG. 1 illustrates an exemplary table layout, according to an embodiment.

Reference will now be made in detail to the presently preferred embodiments of the invention, examples of which are illustrated in the accompanying drawings, wherein like reference numerals refer to like elements throughout.

The present general inventive concept relates to a method, apparatus, and computer readable storage medium, for a new card game involving playing successive stages wherein at each stage the player is trying to achieve a point total without going over.

FIG. 1 illustrates an exemplary table layout, according to an embodiment.

The layout can comprise four betting circles for each player: a first stage betting circle 100, a second stage betting circle 102, a third stage betting circle 104, and a poker betting circle 106.

The layout can also comprise for each player: a first stage card placeholder 108, a second stage card placeholder 110, and a third stage card placeholder 112. The layout can also comprise for the dealer, a first stage dealer card placeholder 114, a second stage dealer card placeholder 116, and a third stage dealer card placeholder 118.

A goal of the game is to reach a predetermined point total for each stage, without exceeding that point total. The goal point totals can be any selected totals by the house, although 11 (for the first stage), 21 (for the second stage), and 31 (for the third stage) can be used. Alternatively, only one, two, or any number of stages can be used. In the three stage embodiment, the player can place three wagers, one for each stage. The player can continue to draw cards and add to his or her total until the player decides to stop drawing or until the player has exceeded the point total for that stage. The dealer can also play similarly to the player according to predetermined house rules. In order to win each wager, the player's point total must be closer than the dealer's point total to the goal point total for each respective stage without going over.

Figure 2:
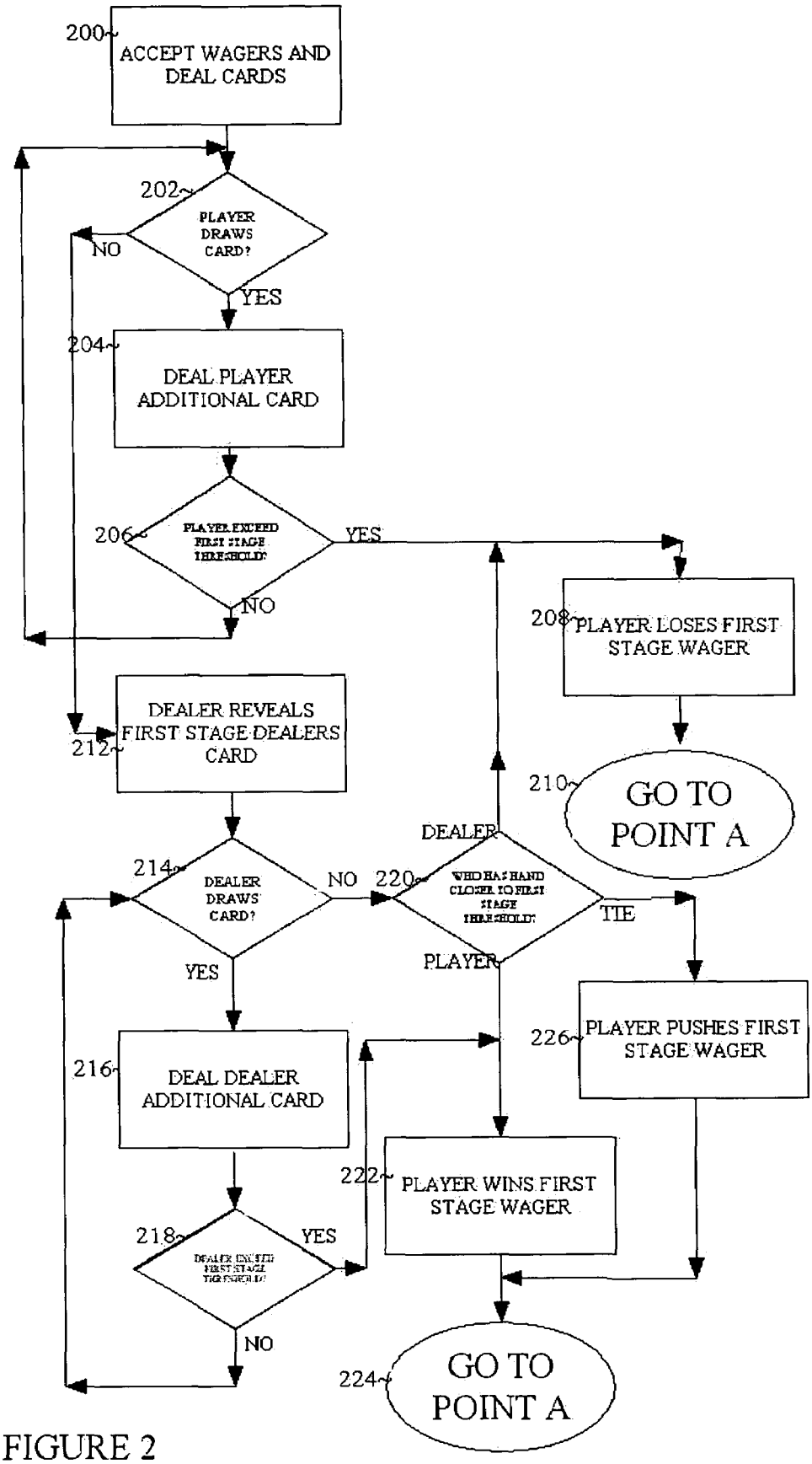
FIG. 2 illustrates an exemplary flowchart illustrating a first stage, according to an embodiment.

FIG. 2 illustrates an exemplary flowchart illustrating a first stage, according to an embodiment.

The method can start with operation 200, which accepts the wagers and deals the cards. A wager can be accepted for each stage (e.g. the first stage, the second stage, and the third stage) and a poker wager can be accepted as well (to be discussed below in more detail). A first stage wager can be placed in the first stage betting circle 100, a second stage wager can be placed in the second stage betting circle 102, and a third stage wager can be placed in the third stage betting circle 104, and a poker wager can be placed in the poker betting circle 106.

Three cards can be dealt to the player: a first stage card on the first stage card placeholder 108, a second stage card on the second stage card placeholder 110, and a third stage card on the third stage card placeholder 112. Three cards can be dealt to the dealer (one for each stage), a first stage dealer card on the first stage dealer card placeholder 114, a second stage dealer card on the second stage dealer card placeholder 116, and a third stage dealer card on the third stage dealer card placeholder 118. All of the cards can typically be dealt face down, although the first stage card can be dealt face up or can be turned up at the start of the game.

The method can then proceed to operation 202, wherein the player decides whether to draw a card after viewing his or her first stage card(s) (which include the first stage card dealt in operation 200 and any additional cards dealt in operation 204. If the player decides to draw a card, then the method can proceed to operation 204, which deals the player an additional card.

From operation 204, the method can proceed to operation 206, which determines if the player has exceeded the first stage threshold (in this example 11). If the player has exceeded 11, then the last card dealt can be withdrawn and the method can proceed to operation 208, wherein the player loses the first stage wager. Note that the first stage wager can be taken at this time, or all the wagers can be reconciled by the dealer when the round is completely over. Nevertheless, if the method reaches operation 208, it signifies that the player has indeed lost the first stage wager during this game. In operation 208, the dealer can also play out his or her hand. Even though the player has lost, the dealer may still need to play out his or her hand if there are other live players at the table, and to also increase the dealer's point total for the next stages. Thus, the dealer will reveal his or her first stage dealer card and then keep hitting while a point total of all dealer cards is less than the dealer first stand hand (7). From operation 208, the method can proceed to operation 210, which goes on to play a second stage of the game.

From operation 206, if the player has not exceeded the first stage threshold (e.g. 11), then the method can return to operation 202 wherein the player can decide whether to draw another card.

In operation 202, if the player does not decide whether to draw another card, then the method can proceed to operation 212, wherein the dealer reveals the first stage dealers card. If the player has a point total equal to the first stage threshold, then (depending on the embodiment) the player may receive a bonus (for example a 3:2 payout on the first wager as opposed to a 1:1 payout), assuming that the dealer also does not have the same point total upon which the player will push. The bonus can be paid in operation 222 (when the player has definitely won), or at the very end of the third stage.

From operation 212, the method can proceed to operation 214, which determines whether the dealer wants to draw another card. This determination can be made according to predetermined house rules. For example, if the dealer's point total is less than a dealer's stand hand (e.g. 7 for the first stage, 17 for the second stage, and 27 for the third stage) than the dealer must draw.

If in operation 214 the dealer has to draw, then the method can proceed to operation 216 in which the dealer deals himself or herself another card (typically face up). From operation 216, the method can proceed to operation 218, which determines whether the dealer's point total exceeds first stage threshold.

If the determination in operation 218 determines that the dealer has not exceeded the first stage threshold, then the method can return to operation 214, wherein the dealer determines whether to draw another card (as discussed herein).

If the determination in operation 218 determines that the dealer has exceeded the first stage threshold, then the method can proceed to operation 222, wherein the player wins the first stage wager. The player can be paid at this point, or the dealer can reconcile all of the wagers at the very end of the game (after all stages have been played). From operation 218, the method proceeds to operation 224, which proceeds to the second stage of the game.

In operation 214, if the dealer decides not to draw another card, then the method can proceed to operation 220, which determines which party (player or dealer) has the hand closest to the first stage threshold. If the player has the hand closest to the first stage threshold, then the method proceeds to operation 222, wherein the player wins the first stage. If the dealer has the hand closest to the first stage threshold, then the method proceeds to operation 208, wherein the dealer wins the first stage and thus the player loses the first stage wager. It is noted that the actual reconciling of wagers (taking, paying, etc.) can happen at the time the winner/loser of each stage is determined, or at the very end of the game (after all stages have been played). From operation 208, the method can proceed to operation 224 which proceeds to the next stage.

If the dealer and the player have the same point total, then the method can proceed to operation 226, wherein the first stage results in a tie and the player's first stage wager pushes. The method can proceed to operation 224 which proceeds to the next stage.

Figure 3:
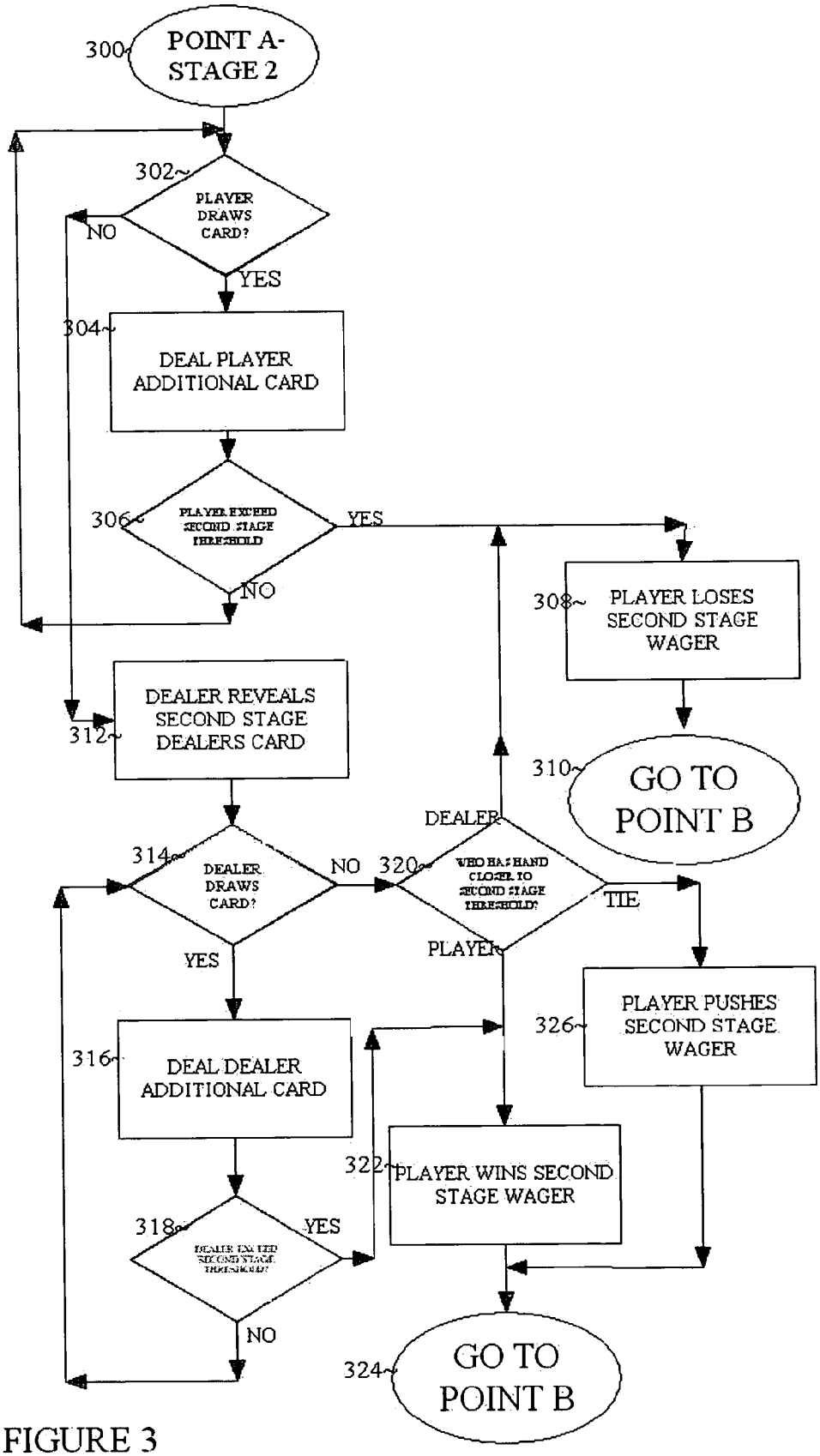
FIG. 3 illustrates an exemplary flowchart illustrating a second stage, according to an embodiment.

FIG. 3 illustrates an exemplary flowchart illustrating a second stage, according to an embodiment.

Note that the second stage plays similarly to the first, and corresponding operations should be carried out similarly as described herein. Note that the cards displayed in the first stage (that were not withdrawn) are used in the point totals for the second stage as well. For example, if the player has a point total of 10 after the first stage is over, this point total carries over to the second stage. This holds true for the dealer as well.

Figure 4:
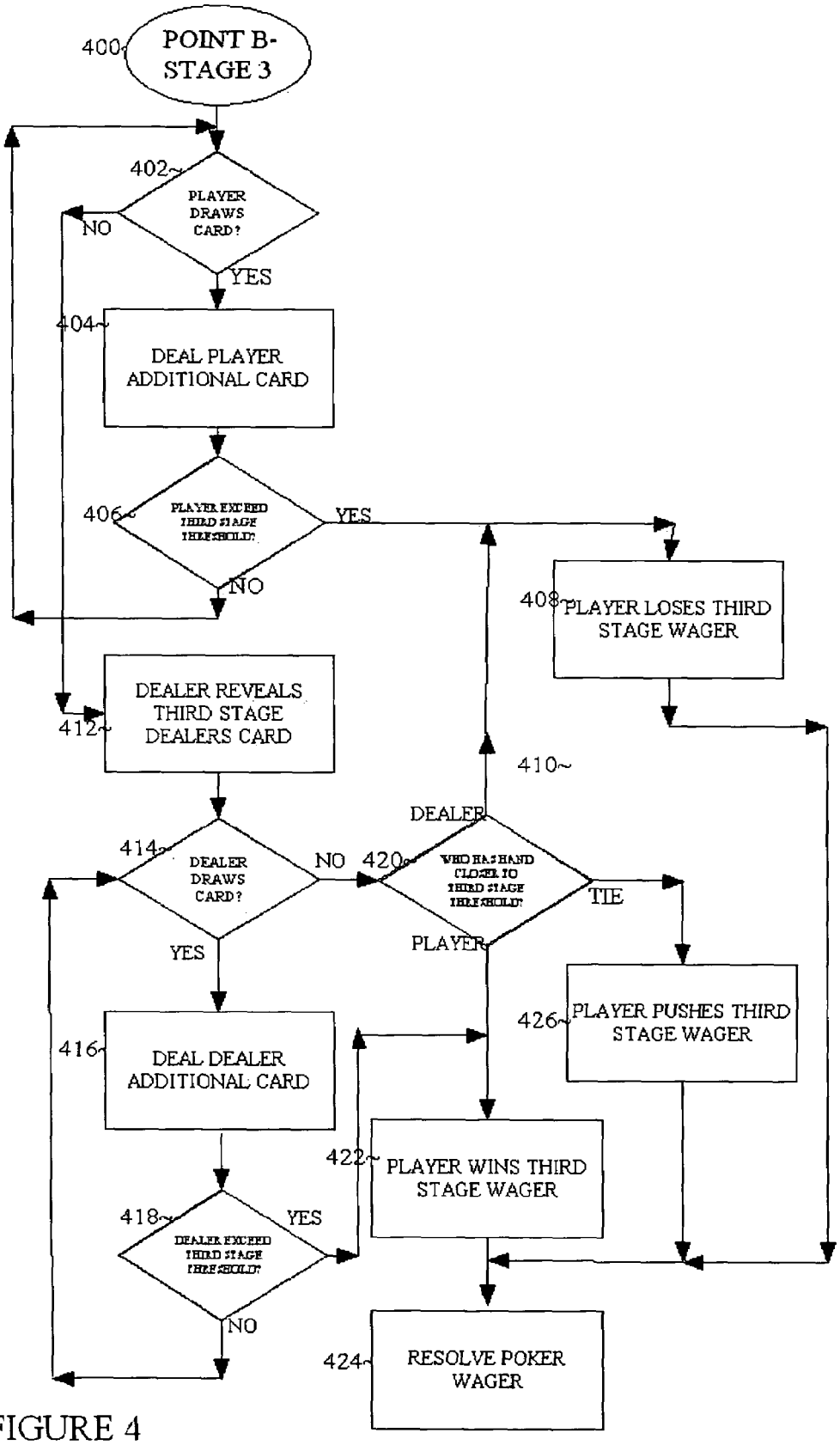
FIG. 4 illustrates an exemplary flowchart illustrating a third stage, according to an embodiment.

FIG. 4 illustrates an exemplary flowchart illustrating a third stage, according to an embodiment.

Note that the third stage plays similarly to the first and second stages, and corresponding operations should be carried out similarly as described herein. Note that the cards displayed in the first stage and the second stage (that were not withdrawn) are used in the point totals for the third stage as well. For example, if the player has a point total of 20 after the second stage, this point total carries over to the third stage as well. This hold true for the dealer as well.

Note that at the end of the third stage, the poker wager is resolved in operation 424. The resolution of the poker wager is discussed below in more detail. In operation 424 all or some of the other wagers can also be taken/paid as well (or they can be taken/paid as soon as they are actually won or lost in the other operations).

It is noted that the thresholds (the amount which the player tries to achieve without going over) for each stage can be set to the casino's preferences. The dealer stand hand (the total dealer amount in which the dealer will stop hitting for that respective stage) can also be set according to the casino's preferences. Table I illustrates exemplary point thresholds and dealer stand hands for stages one, two and three. Note that the game can come in any number of stages (e.g. 1, 2, 3 or more). The bonus the player receives when his point total equals the respective point threshold can also be adjusted to suit the casino's needs (e.g. the player can receive 3:2 bonus payout vs. a regular 1:1 win, or any other bonus amount).

TABLE I

| Stage | point threshold | dealer stand hand |
|---|---|---|
| 1 | 11 | 7 |
| 2 | 21 | 17 |
| 3 | 31 | 27 |

Figure 5:
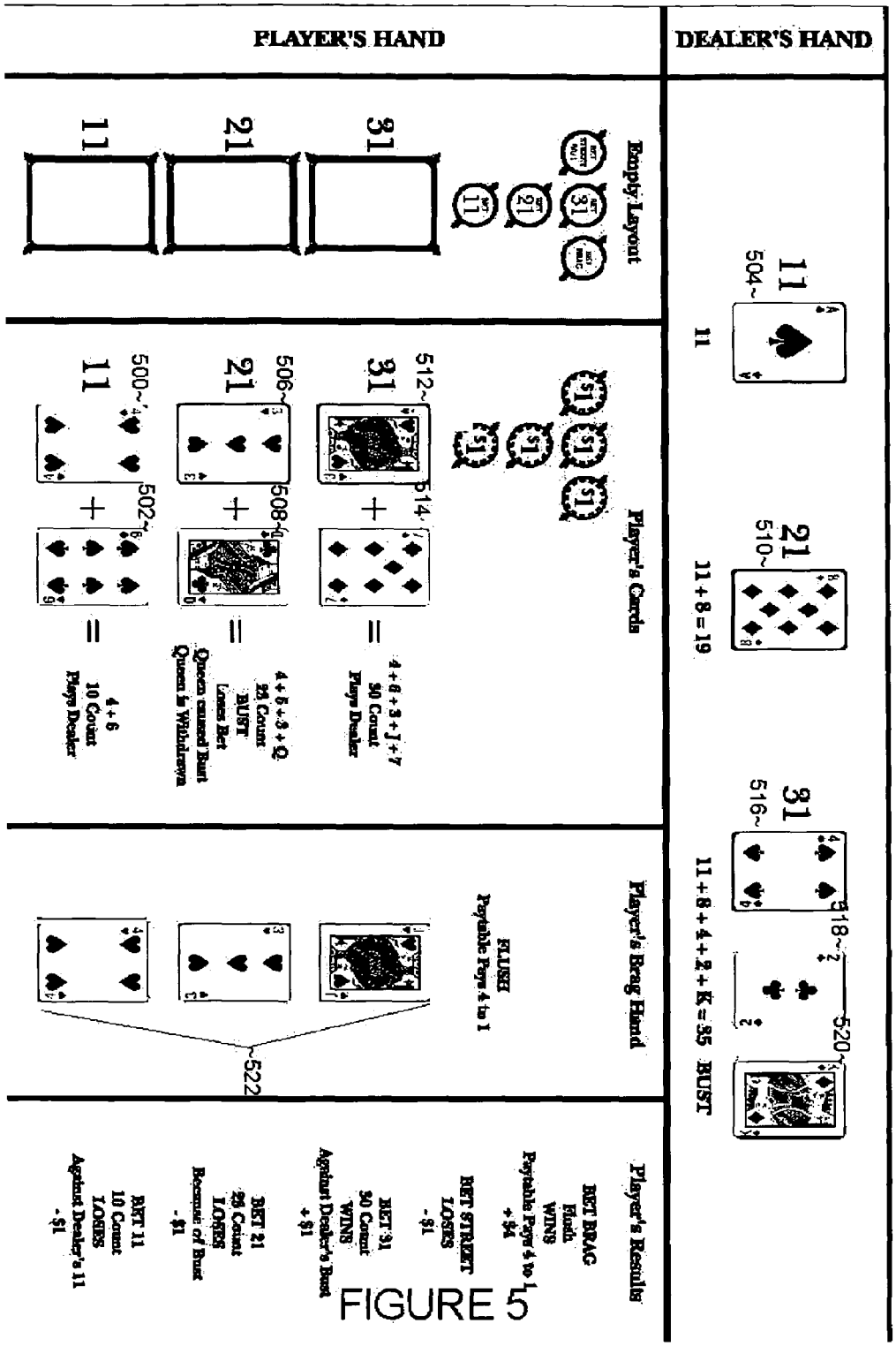
FIG. 5 illustrates an exemplary round of methods described herein, according to an embodiment.

FIG. 5 illustrates an exemplary round of methods described herein, according to an embodiment. The player makes his or her five wagers (one for each stage, the poker wager, and the bonus street bet). Note that the house rules may require all of these bets, may require only one of these bets, or may require any combination of these bets (e.g. all three stage bets may be required while the other two may be optional), or may allow the player to make any combination of these bets. The bonus street bet is where the player is betting on receiving an ace for the first stage card followed by a 10 or face card for the second stage card following by another 10 or face card for the third stage card. This wager may be optionally offered by the casino and optionally played by the player.

The player is dealt a first stage card 500 which is a 4*h*. The player decides to take another card and is dealt an additional first stage card 502 which is a 6*s*. the player now has a total of 10 (4+6) and since this is close to 11 (the first stage threshold), the player decides to stand.

The dealer then deals the first stage dealer card 504 which is an As. Note that in this game an ace can have a value of 1 or 11, although in other embodiments the ace may be allowed only the value of 1 or only the value of 11. Since the dealer's point total is greater than the first dealer stand hand (7), the dealer stands. Since the dealers point total (11) is closer to 11 (the first stage threshold) than the players point total (10), the dealer wins stage one and the player loses his or her first wager.

The dealer then deals the player a second stage card 506 which is a 3*h*, for a point total of 13 (4+6+3). The player decides to draw an additional second stage card 508 which is a Qc for a point total of 23 (4+6+3+10). Since this is higher than the second stage threshold (21), the player has exceeded the second stage threshold and the player loses. Note that in an embodiment of the game, the card causing the player to exceed the respective threshold (the Qc in this case) can be considered withdrawn and will not count towards future point totals.

The dealer then deals the second stage dealer card 510 which is an 8*d*. The dealer now has a point total of 19 (11+8). The dealer's point total does not matter in this example since the player has exceeded the second stage threshold, although if there are other players playing at the table then those players still may be live.

The dealer then deals the player a third stage card 512 which is a Jh. The players point total is now 23 (4+6+3+10). Note the queen does not count in this point total but the jack does. The player decides to take another card and so the player is dealt an additional third stage card 514 which is a 7*d*. The player's point total is now 30 (4+6+3+10+7).

The dealer then deals the third stage dealer card 516 which is a 4*s*. The dealer's total is now 23 (11+8+4). Since 23 is less than the third stage stand hand (27), the dealer deals an additional third stage dealer card 518 which is a 2*c*. Since the point total is now 25 (which is less than 27), the dealer deals another additional third stage dealer card 520 which is a Kd. The dealer's point total is now 35, which is greater than the third stage threshold (31) so the dealer has "busted." The player thus wins his or her third wager.

The player's poker wager is now resolved. A poker hand can be formed from the player's first stage card 500 (4*h*), the player's second stage card 506 (3*h*), and the player's third stage card 512 (Jh). Since all of these cards are hearts, the three card player's poker hand is a flush.

The dealer's three card poker hand can be formed from the first stage dealer card 504 (As), the second stage dealer card 510 (8*d*), and the third stage dealer card 516 (4*s*). The poker rank of this three card hand is ace high. Since the player's flush beats ace high, the player wins the poker bet. The poker bet can be paid at a paytable such as that illustrated in Table II or in Table III, although of course these paytables are merely examples and others may be used as well.

TABLE II

| | |
|---|---|
| Straight flush | 35:1 |
| 3 of a kind | 25:1 |
| straight | 6:1 |
| flush | 3:1 |
| pair | 1:1 |

TABLE III

| | |
|---|---|
| Street | 50:1 |
| Straight flush | 40:1 |
| 3 of a kind | 30:1 |
| straight | 6:1 |
| flush | 4:1 |
| pair | 1:1 |

The poker payout can be made if the player's hand beats the dealer's hand. Alternatively, a player can receive a poker payout based on the player's three card hand alone (the dealer's hand does not matter). Alternatively, a player's poker hand can be formed from all of the player's cards that did not cause a bust (or alternatively these cards can be allowed). For example the player can make the best 3 card hand (or 4 card hand or 5 card hand etc) out of all his cards, and receive a paytable payout based on this hand. Alternatively, the player can take this hand against the dealer (which can form a dealer's poker hand from all of the dealer's cards that did not cause a bust (or alternatively these cards can be allowed)), and if the player's hand is higher the player wins a paytable payout.

Table IV below illustrates a further example of a particular instance of methods described herein.

TABLE IV

| PLAYER CARDS | | DEALER CARDS | |
|---|---|---|---|
| POSITION/ BET | CARDS DELIVERED EXAMPLE | POSITION/ BET | CARDS DELIVERED EXAMPLE |
| 31 | 8d<br>Draws 3d + 8d + 9h + 10c = 30 total to win on position 31 | 31 | 10d<br>Has 10d + 6h + 6c + 5d Total 27 which loses to Players 30 |
| 21 | 9h<br>Stays at 19 (9h + 10c) and wins on position 21 | 21 | 6h<br>Dealer has 6h + 6c + 5d (Stays with 17 and loses to players 19 on position 21) |
| 11 | 10c<br>Player stays at 10 Beats dealer's 10 on position 11 | 11 | 6c<br>Draws 5d<br>(5d + 6C wins with 11, which beats players 10) |
| Poker Bet | Wins Poker with Straight 8/9/10<br>Pay Table 6:1 | Poker Bet | Two 6's - Pair Loses to Straight (if game played with requirement that player must beat dealer in order to win) |

The instance of the game as illustrated in Table IV occurs as follows. The player makes a first stage wager, a second stage wager, a third stage wager, and a poker hand wager. The player's first stage card is a 10*c*. The player stays. The first stage dealer card is a 6*c*. Since this is less than the first stand hand (7), the dealer draws an additional first stage dealer card and gets a 5*d*, for a total of 11 which beats the player's 10. Thus, the player has lost the first stage.

The player's second stage card is revealed which is a 9*h*, giving the player a point total of 19. The dealer has a total of 11 and reveals the second stage dealer card which is 6*h* for a total of 17. Since this equals the 17, the dealer stands. Since the player has 19 and the dealer has 17, the player is closer to the second stage threshold and wins the second stage bet.

The player's third stage card is revealed to be an 8*d*, giving the player a point total of 27. The player decides to draw and draws an additional third stage card of 3*d*, for a point total of 30. The player decides to stand. The dealer reveals the third stage dealer card which is 10*d*, so the dealer has a point total of 27. Since the dealer's point total of 27 is equal to the third stage stand hand, the dealer does not draw any more. The player's total of 30 beats the dealer's total of 27 and the player wins the third stage wager.

Now the poker wager is resolved, and the player has a 8/9/10 straight which beats the dealer's pair. Thus the player can win a 6:1 payout for his straight since he beat the dealer. In an alternate embodiment, the dealer's poker hand is irrelevant and the player's hand is simply paid out according to a paytable (for example see Table II and Table III).

In an alternative embodiment, a dealer does not play and each player is paid his or her hand according to only each player's cards without need to beat the dealer. This embodiment is similar to the prior described embodiments but the player is paid according to a paytable for each stage and there is no comparison to a dealer's hand.

Figure 6:
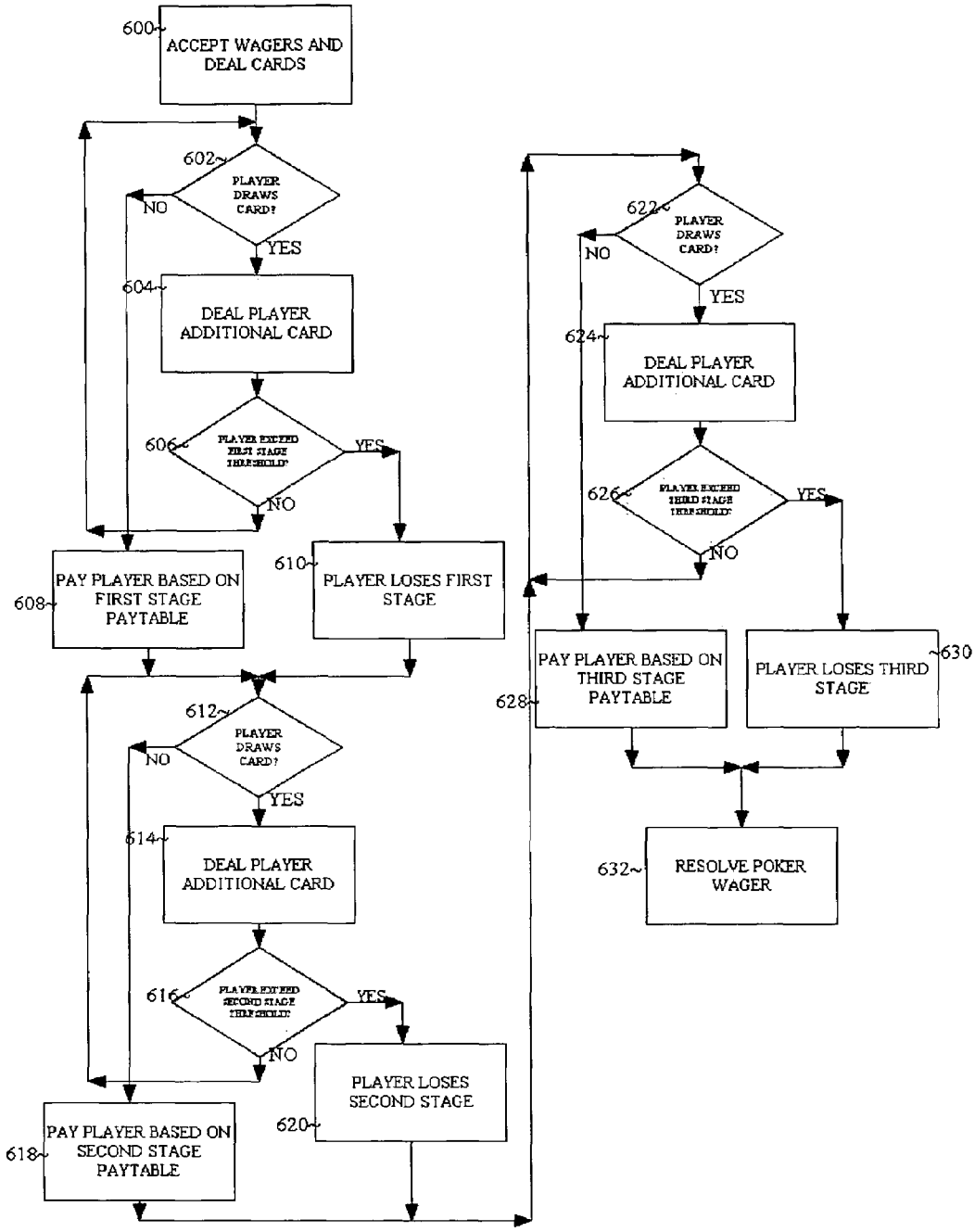
FIG. 6 illustrates an exemplary flowchart illustrating a first stage in an alternative embodiment, according to an embodiment.

FIG. 6 illustrates an exemplary flowchart illustrating a first stage in an alternative embodiment, according to an embodiment.

The idea in this embodiment, like the embodiment illustrated in FIG. 2, is to come as close to the point thresholds (for example those illustrated in Table I) in each stage without exceeding it. This embodiment can be played as illustrated in FIGS. 2–4, without the dealer, and according to any other changes noted herein.

This embodiment can start with operation 600 which accepts wagers and deals cards. There can be one, two, three, or more stages and there can be a wager on each of the stages (the player may be required to play all or some combination of wagers or the player may have the option of playing any). There can also be an optional or mandatory poker wager as well. This example assumes three stages, thus three wagers are made plus a poker wager. A card for each stage can be dealt (stage two and stage three should be dealt face down), or only a card for the first stage can be dealt now and the other cards will be dealt when needed. The first stage card is revealed.

In operation 602 the player sees his card(s) and decides whether to hit or stand. If the player decides to hit, the method can proceed to operation 604, which deals the player an additional card, and then proceeds to operation 606, which determines whether the total card values of all of the cards has exceeded the first stage threshold. If so, the method can proceed to operation 610 wherein the player has lost the first stage. If the player has not exceeded the first stage threshold in operation 606, then the method can return to operation 602 again.

From operation 602, if the player decides not to take a further card, then the method can proceed to operation 608, wherein the player can be paid based on the total card value of all of the cards. A paytable such as that in Table 5 can be used to determine the payout for a point total for each stage. For example, in stage 1, if the player has a point total of 10, then the player can win 3 times his first wager (if he or she bet $1 he or she gets $3 with a profit of $2). If the player has a point total of 8, the player pushes (one times his or her first stage wager). If the player has a point total of 6, the player loses his first stage wager (zero times his wager is zero). Note that the player is not necessarily a winner if he or she makes it to operation 608, the player's point total still needs to be a certain value.

TABLE V

| stage 1 total | payout | stage 2 total | payout | stage 3 total | payout |
|---|---|---|---|---|---|
| Under 2–7 | 0 | under 18 | 0 | under 25 | 0 |
| 8 | 1 | 18 | 1 | 26–27 | 1 |
| 9 | 1 | 19 | 1 | 28–29 | 3 |
| 10 | 3 | 20 | 2 | 30 | 5 |
| 11 | 4 | 21 | 5 | 31 | 8 |

From operations 608 and 610, the method can proceed to the second stage of the game, which is played similarly to the first stage. If a card the player drew in operation 604 cause the player to go over the first stage threshold, then this card may be considered withdrawn and not used in the point totals for stages two and three (although in an alternative embodiment such a card would not be considered withdrawn).

In stage two, operations 612 to 616 can be performed wherein the player continues hitting and accumulating point totals until the player has exceeded the second stage point total or the player decides to stop hitting. If the player has exceeded the second stage point threshold, then the method proceeds to operation 620, wherein the player loses his or her second stage wager. If the player stops hitting, then the method proceeds to operation 618, wherein the player can be paid according to a paytable such as that illustrated in Table V. For example, if the player stops hitting with a point total of 17 in this second stage, the player has lost his or her second stage wager.

From operations 618 and 620, the method can proceed to stage three, wherein operations 622 to 626 can be performed wherein the player can keep hitting until the player exceeds the third stage point threshold or the player wishes to stop hitting. Depending on the current embodiment being played (the house rules), a card that may have caused the player to exceed the second stage threshold may or may not be considered withdrawn and thus may or may not count in the point total for stage three.

In operation 626, if the player has exceeded the third stage point threshold, then the player loses his or her third stage wager in operation 630. If in operation 622, the player has decided not to draw any further cards, then the method can proceed to operation 628 wherein the player is paid based on the third stage paytable.

From operations 628 and 630, the method can then proceed to operation 632, which resolves the poker wager, if made. This can be performed by forming a poker hand from the first cards dealt in each stage (e.g. the first stage card, the second stage card, and the third stage card), and the three card poker hand formed therein can be paid according to a paytable.

It is noted that the methods illustrated in FIG. 6 and described herein (as well as the other figures as well), do not need to meet a literal match to the description herein. For example, the wagers can actually paid at any sensible point in time. Cards may be dealt face down and revealed or dealt face up at a later time. The layouts of the cards also do not need to be in the particular arrangement as illustrated in FIGS. 1 and 7.

Figure 7:
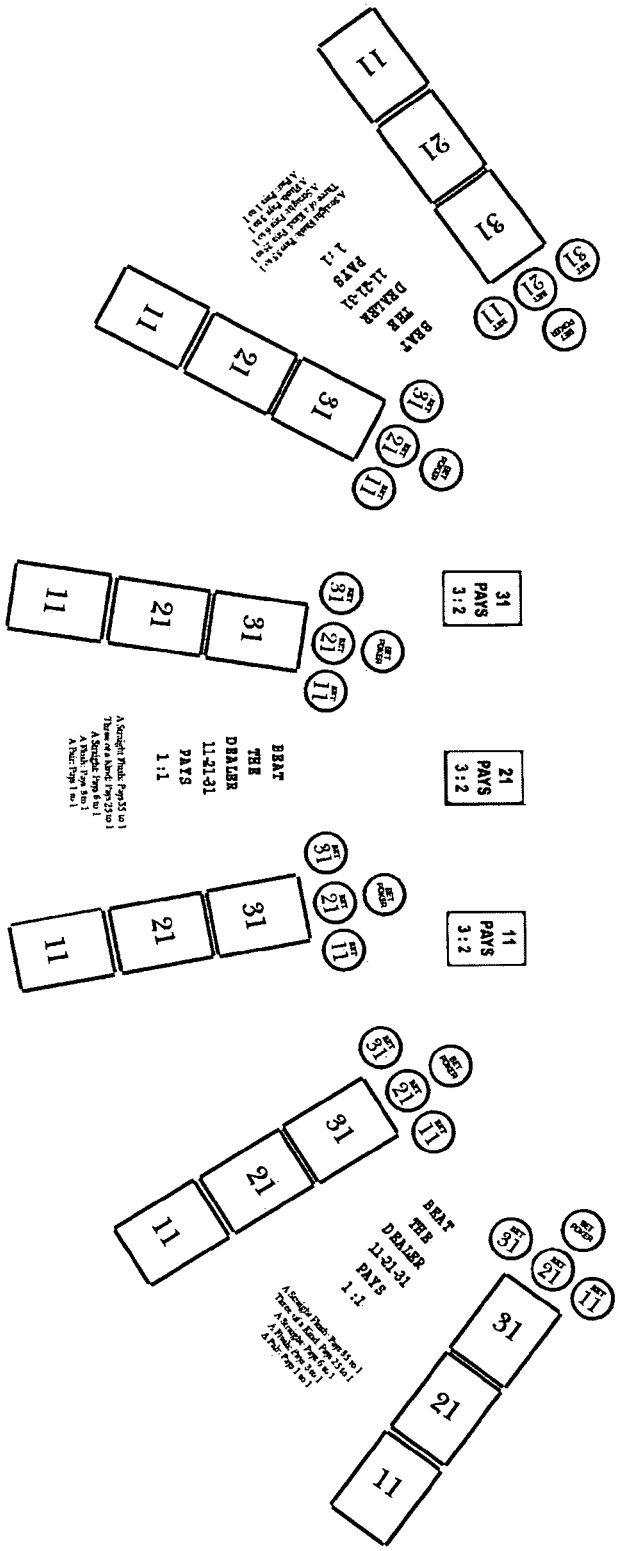
FIG. 7 illustrates an exemplary alternate table layout, according to an embodiment.

FIG. 7 illustrates an exemplary alternate table layout, according to an embodiment. This layout is similar to the layout in FIG. 1 but does not have the "Street Wager," thus up to four wagers can be placed simultaneously per player (although of course a player can play multiple seats if the casino allows this).

Thus, as illustrated herein, methods described herein can combine exciting aspects of blackjack and brag into a single game, while accepting multiple bets to generate more action for the casino.

Further, all of the games and variations described herein can also be played on an electronic gaming device (EGD). The methods described herein can be programmed and stored on a digital computer. The games may also be played over a computer communications network (such as the Internet).

Figure 8:
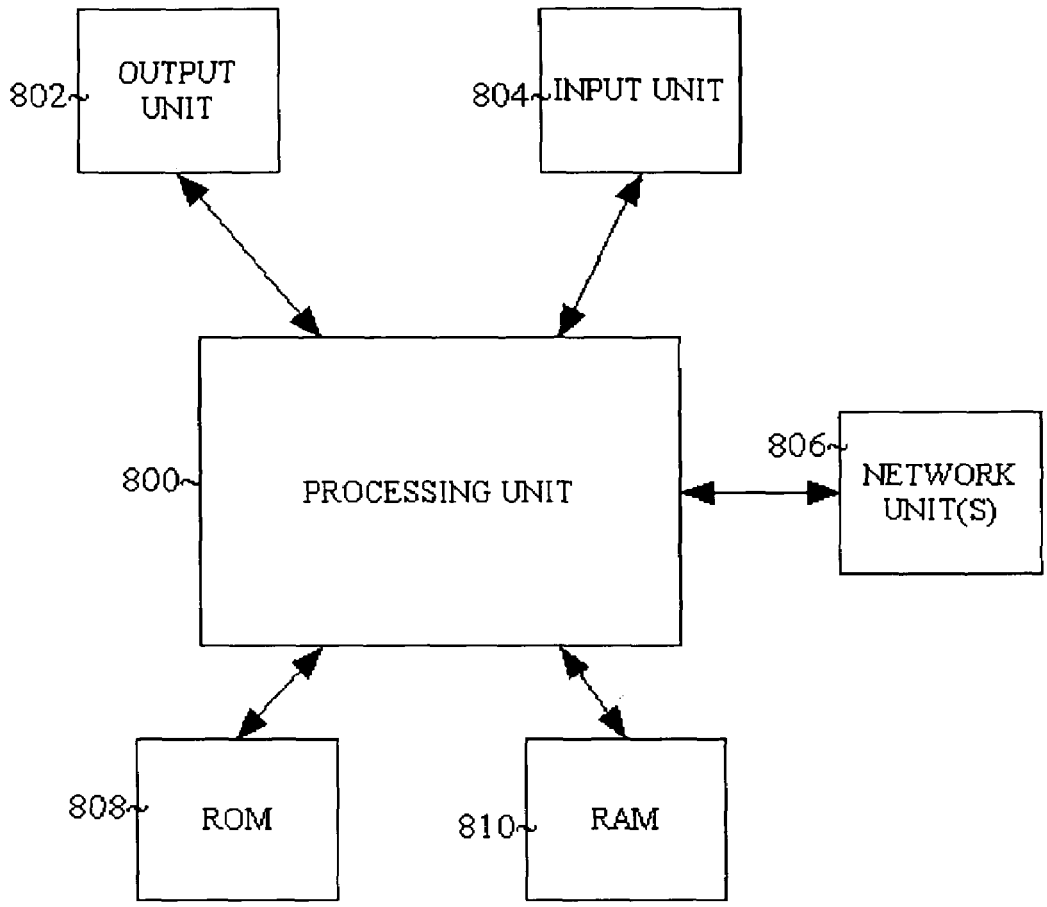
FIG. 8 illustrates an exemplary block diagram of hardware that can be used to implement methods described herein, according to an embodiment.

FIG. 8 illustrates an exemplary block diagram of hardware that can be used to implement methods described herein, according to an embodiment.

A processing unit 800 can be connected to an output unit 802 (e.g. CRT, etc.) and an input unit 804 (buttons, keyboard, etc.) The processing unit 800 can also be connected to a ROM 808, a RAM 810, and a network unit 806 which can connect the unit to a computer communications network (e.g. Internet or casino LAN, etc.)

It is also noted that any and/or all of the above embodiments, configurations, variations of the present invention described above can mixed and matched and used in any combination with one another.

Moreover, any description of a component or embodiment herein also includes hardware, software, and configurations which already exist in the prior art and may be necessary to the operation of such component(s) or embodiment(s).

Further, the operations described herein can be performed in any sensible order. For example, when a player wins a particular stage the player can be paid at that point in time or when the entire game (all stages) is over. As another example, if the player exceeds a current respective point threshold for that stage, the dealer can take the players respective wager at that point or continue to play out the entire game before taking the wager. Further, cards can be dealt face down and revealed at a later time or dealt face up, as each of these variations are interchangeable. Any operations not required for proper operation can be optional. Further, all methods described herein can also be stored on a computer readable storage to control a computer.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A method to play a wagering game, the method comprising:

receiving a first wager and a second wager from a player;

allowing the player to receive and view a first set of player card(s) until the player decides to stop or a point total of all player cards dealt is greater than a first stage threshold;

if the point total of all player cards exceeds the first stage threshold, then taking the first wager from the player;

allowing the dealer to continue to receive and view dealer card(s) while a point total of all dealer cards is less than a dealer first stage hand;

if the point total of all player cards does not exceed the first stage threshold and the point total of all player cards is closer to the first threshold than the point total of all dealer cards, then the player wins based on the first wager;

allowing the player to continue to receive and view player card(s) until the player decides to stop or a point total of all player cards dealt is greater than a second stage threshold;

if the point total of all player cards exceeds the predetermined second threshold, then taking the second wager from the player;

allowing the dealer to continue to receive and view dealer card(s) while a point total of all dealer cards is less than a dealer second stand hand; and if the point total of all player cards does not exceed the second stage threshold and the point total of all player cards is closer to the second stage threshold than the point total of all dealer cards, then paying the player based on the second wager.

2. A method as recited in claim 1, wherein if a particular player card causes the player to exceed the first stage threshold, then the particular player card is considered withdrawn and is not incorporated in the point total of all players cards in the second stage.

3. A method as recited in claim 1, wherein if the point total of all player cards equals the first stage threshold, then the player is paid a bonus amount based on the first wager.

4. A method as recited in claim 1, wherein the predetermined first stage threshold is 11.

5. A method as recited in claim 4, wherein the predetermined second threshold is 21.

6. A method as recited in claim 1, wherein the dealer first stand hand is 7.

7. A method as recited in claim 1, wherein the dealer first stand hand is 7.

8. A method as recited in claim 1, further comprising forming a player poker hand with three player cards.

9. A method as recited in claim 8, further comprising forming a dealer poker hand with three dealer cards and paying a third wager made by the player if the player poker hand is better than the dealer poker hand.

10. A method to play a wagering game, the method comprising:

receiving a first wager and a second wager from the player;

revealing a first stage card to the player;

allowing the player to receive additional first stage card(s) as many times as the player wishes or until a first stage point total of the first stage cards exceeds a first threshold;

dealing dealer cards totaling a dealer point total;

if the first stage point total exceeds the first threshold or the first stage point total is not closer to the first threshold than the dealer point total then the player has lost the first wager, and if the first stage point total is closer to the first threshold than the dealer point total than the player wins a multiple of the first wager based on the first stage point total;

revealing second stage card to a player;

allowing the player to receive additional second stage card(s) as many times as the player wishes, wherein if a second stage point total of at least one first stage card(s) and the second stage card(s) exceeds a second threshold then the player loses the second wager.

11. A method as recited in claim 10, wherein any additional first stage additional cards that cause the player to exceed the first threshold are considered withdrawn and are not used in the second stage point total.

12. A method as recited in claim 10, further comprising forming a player poker hand with three player cards.

13. A method as recited in claim 12, further comprising forming a dealer poker hand with three dealer cards and paying a third wager made by the player if the player poker hand is better than the dealer poker hand.

14. A method as recited in claim 10, further comprising:

dealing dealer cards totaling a second dealer point total, if the second stage point total exceeds the second threshold or if the second stage point total is not closer to the second threshold than the second dealer point total then the player has lost the second wager, and if the second stage point total is closer to the second threshold than the second dealer point total then paying the player a multiple of the second wager based on the second stage point total.

15. A method to play a wagering game, the method comprising:

receiving a first wager and a second wager from a player;

dealing first stage cards to the player successively until the player no longer wishes to receive first stage cards;

totaling a first point total comprising point values of all of the first stage cards and concluding that the first point total exceeds a first stage threshold;

taking the first wager from the player, wherein the first wager is considered a loss by the player;

dealing second stage cards to the player successively until the player no longer wishes to receive second stage cards;

totaling a second point total comprising point values of all of the second stage cards and at least one first stage card(s) and concluding that the second point total exceeds a second stage threshold; and taking the second wager from the player, wherein the second wager is considered a loss by the player.

* * * * *